US007438058B2

(12) United States Patent
Ito et al.

(10) Patent No.: US 7,438,058 B2
(45) Date of Patent: Oct. 21, 2008

(54) DRAIN PIPE IN CANISTER SYSTEM

(75) Inventors: Tetsuhiro Ito, Saitama (JP); Naritoshi Muramatsu, Saitama (JP); Takenobu Haga, Saitama (JP); Hiroaki Mihara, Saitama (JP); Yasuhiro Hasegawa, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/712,568

(22) Filed: Feb. 28, 2007

(65) Prior Publication Data

US 2007/0215123 A1 Sep. 20, 2007

(30) Foreign Application Priority Data

Mar. 2, 2006 (JP) ..... 2006-056855

(51) Int. Cl.
*F02M 33/02* (2006.01)

(52) U.S. Cl. ..... 123/518; 123/519; 123/520

(58) Field of Classification Search ..... 123/516, 123/518–520; 220/834; 180/68.3, 69.5
See application file for complete search history.

(56) References Cited

U.S. PATENT DOCUMENTS 3,874,471 A * 4/1975 Kloefkorn ..... 180/69.4
4,727,955 A * 3/1988 Honda et al. ..... 180/296
4,787,643 A * 11/1988 Shirata ..... 280/834
4,793,839 A * 12/1988 Hayashida et al. ..... 96/130
4,805,581 A * 2/1989 Yamada et al. ..... 123/519
5,058,693 A * 10/1991 Murdock et al. ..... 180/69.4
5,060,620 A * 10/1991 Oslapas ..... 123/519
5,111,900 A * 5/1992 Leitermann ..... 180/69.4
5,195,780 A * 3/1993 Inoue et al. ..... 280/834
5,224,455 A * 7/1993 Ogasawara ..... 123/519
5,267,470 A * 12/1993 Cook ..... 73/49.7
5,409,264 A * 4/1995 Nakatani ..... 280/834
5,427,076 A * 6/1995 Kobayashi et al. ..... 123/520
5,687,697 A * 11/1997 Ishikawa ..... 123/520
5,702,125 A * 12/1997 Nakajima et al. ..... 280/834
5,727,530 A * 3/1998 Honda et al. ..... 123/520
5,813,491 A * 9/1998 Sato et al. ..... 180/309
5,840,104 A * 11/1998 Hashimoto et al. ..... 96/135
5,850,819 A * 12/1998 Kunimitsu et al. ..... 123/520

(Continued)

FOREIGN PATENT DOCUMENTS

JP 09-049460 2/1997

(Continued)

*Primary Examiner*—Thomas N Moulis
(74) *Attorney, Agent, or Firm*—Carrier, Blackman & Associates, P.C.; Joseph P. Carrier; William D. Blackman

(57) ABSTRACT

In order to discharge air cleaned free from evaporated fuel vapor in a canister installed under the front seat floor, have none of the air coming inside a passenger room and inhibit water, dirt and dust from being absorbed in a drain pipe in a canister, the following drain pipe in a canister is invented. The drain pipe in canister is connected with a canister body installed under a front seat floor of a vehicle. The drain pipe in the canister comprises a first part extending from the canister body up to an upper portion of an engine room disposed on a front side of a passenger room, and a second part extending from the first part to a portion under a floor of the passenger room.

11 Claims, 6 Drawing Sheets

U.S. PATENT DOCUMENTS

| | | | | |
|---|---|---|---|---|
| 5,855,198 | A * | 1/1999 | Nakajima et al. | 123/520 |
| 5,868,428 | A * | 2/1999 | Ishikawa | 280/834 |
| 6,308,987 | B1 * | 10/2001 | Mitake | 280/834 |
| 6,875,258 | B2 * | 4/2005 | Kuperus | 96/147 |
| 6,893,047 | B2 * | 5/2005 | Chou et al. | 280/834 |
| 7,097,697 | B2 * | 8/2006 | Nakamura et al. | 96/134 |
| 7,134,426 | B2 * | 11/2006 | Uchino et al. | 123/518 |
| 7,140,642 | B2 * | 11/2006 | Ito et al. | 280/834 |
| 7,237,644 | B2 * | 7/2007 | Matsumoto et al. | 180/309 |
| 2004/0200356 | A1 * | 10/2004 | Kuperus | 96/147 |

FOREIGN PATENT DOCUMENTS

| | | |
|---|---|---|
| JP | 2582688 | 7/1998 |
| JP | 2005-313667 | 11/2005 |

* cited by examiner

DRAIN PIPE IN CANISTER SYSTEM

CROSS REFERENCE TO RELATED APPLICATIONS

This application claims the foreign priority benefit under Title 35, United States Code, § 119(a)-(c), of Japanese Patent Application No. 2006-056855, filed on Mar. 2, 2006 with the Japanese Patent Office, the disclosure of which is herein incorporated by reference in its entirety.

BACKGROUND OF THE INVENTION

The present invention relates to a drain pipe connected with a canister system installed under the floor of a vehicle on which front seats are attached.

Conventionally a vehicle is provided with a canister system to contain an active charcoal functioning as an absorbent to have fuel vapor adsorbed, as indicated, for instance, by such references as Japanese Utility Model Registration No. 2582688, Japanese Laid-open Patent Application No. H09-49460 and Japanese Laid-open Patent Application No. 2005-313667.

There is a drain pipe attached to the canister body through which cleaned air after the fuel vapor is adsorbed and removed is to be discharged into the atmosphere and air in the atmosphere is to be taken in. Generally speaking the canister system for a vehicle is installed in either an engine room of a vehicle, under a rear seat floor of a vehicle or under a front seat floor of a vehicle as indicated, for instance, by such references as Japanese Utility Model Registration No. 2582688, Japanese Laid-open Patent Application No. H09-49460 and Japanese Laid-open Patent Application No. 2005-313667.

In the case of a canister system installed in an engine room, the canister body is fixed on a vehicle body on the front side of the dash board, as indicated, for instance, by Japanese Utility Model Registration No. 2582688. A drain pipe with a lower end open, which communicates with the atmosphere, is attached to the lower part of the canister body.

In the case of a canister system installed under a rear seat floor of a vehicle, a canister body is fixed on the front side of a rear fender, while a drain filter (filter box) connected through a drain pipe (drain passage) with the canister body and a discharge pipe are installed on the rear side of the rear fender. The cleaned air after the fuel vapor is adsorbed and removed is discharged into the atmosphere through this discharge pipe.

In the case of the canister system indicated by Japanese Utility Model Registration No. 2582688 and Japanese Laid-open Patent Application No. HEI9-49460, no fuel vapor flows into a passenger room and no water comes into the canister body in case the vehicle floor is flooded with water because the canister body is located higher than the vehicle floor.

The canister system disposed under the front seat floor of a vehicle is attached in a so called center tank vehicle in which the passenger room of the rear seats is made relatively spacious and the center of gravity is located relatively low, while a fuel tank is installed under the front seat floor, as indicated by Japanese Laid-open Patent Application No. 2005-313667. Especially in the case of the center tank vehicles equipped with On-board Refusing Vapor Recovery ( to be abbreviated as ORVR hereinafter) capable of recovering fuel vapor, a canister body is installed adjacent to and in the vicinity of the fuel tank and connected with a fuel tank through a vent pipe (communication pipe). Thanks to this configuration, the fuel vapor generated from inside the fuel tank is adsorbed on the adsorbent and the air communication resistance between the fuel tank and the canister body is reduced. Moreover a drain pipe is attached to the canister body to take in air from the atmosphere when purging the canister body to have the adsorbed fuel sent to an engine.

However there is an drain opening located at a relatively low position under the vehicle floor in the case of the center tank vehicle equipped with ORVR, which is described in Japanese Laid-open Patent Application No. 2005-313667. Through this drain opening such water as from rainwater and dirt and dust are easily absorbed together with air from the atmosphere into a canister system. As a result, there is a problem with a drain filter being easily clogged.

The present invention is to solve the aforementioned problem and intended to provide the drain pipe in the canister system which is installed under the front seat floor of a vehicle, prevent the air after fuel vapor is adsorbed and removed from flowing into a passenger room and inhibit water, dirt and dust being absorbed into a drain filter.

SUMMARY OF THE INVENTION

A first aspect of the present invention provides a drain pipe in a canister system which is connected with a canister body and installed under a front seat floor of a vehicle, the drain pipe in the vehicle, comprising a first part extending from the canister body up to an upper space of an engine room disposed on a front side of a passenger room, and a second part extending from the first part to a space under the passenger room, which communicates with an atmosphere under the floor of the passenger room.

According to the first aspect of the present invention, the drain pipe has its one end connected with the canister body which is disposed under the front seat floor of the vehicle and extends to an upper portion of the engine room and further back to a portion under a floor of the passenger seat with the other end exposed to the atmosphere.

As a result, fuel vapor in the upper portion in the fuel tank is adsorbed in the canister body and the air cleaned free from the fuel vapor is transported once to the engine room and then back to under the passenger seat floor and discharged into the atmosphere without coming inside the passenger room. Moreover dirt and dust are inhibited from coming inside the canister system.

A second aspect of the present invention provides a drain pipe in a canister system according to the first aspect, further comprising a drain filter installed at or in a vicinity of a highest portion of the drain pipe in the canister system.

According to the second aspect of the present invention, a drain filter is installed at a relatively high position in the drain pipe and kept a sufficiently long distance off the road surface where there remains dirt and dust, or water. As a result, dirt and dust, or water drops are prevented from coming up to the drain filter and the drain filter is not clogged.

A third aspect of the present invention provides a drain pipe in a canister system according to the second aspect, further comprising a branch pipe which an auxiliary pipe branches from and is installed in a vicinity of the drain filter and on an atmosphere exposed side of the drain filter, wherein the branch pipe has a double concentric pipe structure.

According to the third aspect of the present invention, the drain pipe is equipped with a branch pipe from which the branch pipe branches in the vicinity of the drain filter and on the atmosphere exposed side of the drain filter and the branch pipe has a double pipe structure. Due to this double pipe structure, air coming through the drain filter is inhibited from flowing into the auxiliary pipe while air flows to and from the auxiliary pipe when the flow resistance of the main drain pipe becomes high.

BRIEF DESCRIPTION OF THE DRAWINGS

The object and features of the present invention will become more readily apparent from the following detailed description taken in conjunction with the accompanying drawings in which.

The same or corresponding elements or parts are designated with like references throughout the drawings.

DETAILED DESCRIPTION OF THE INVENTION

Figure 1:
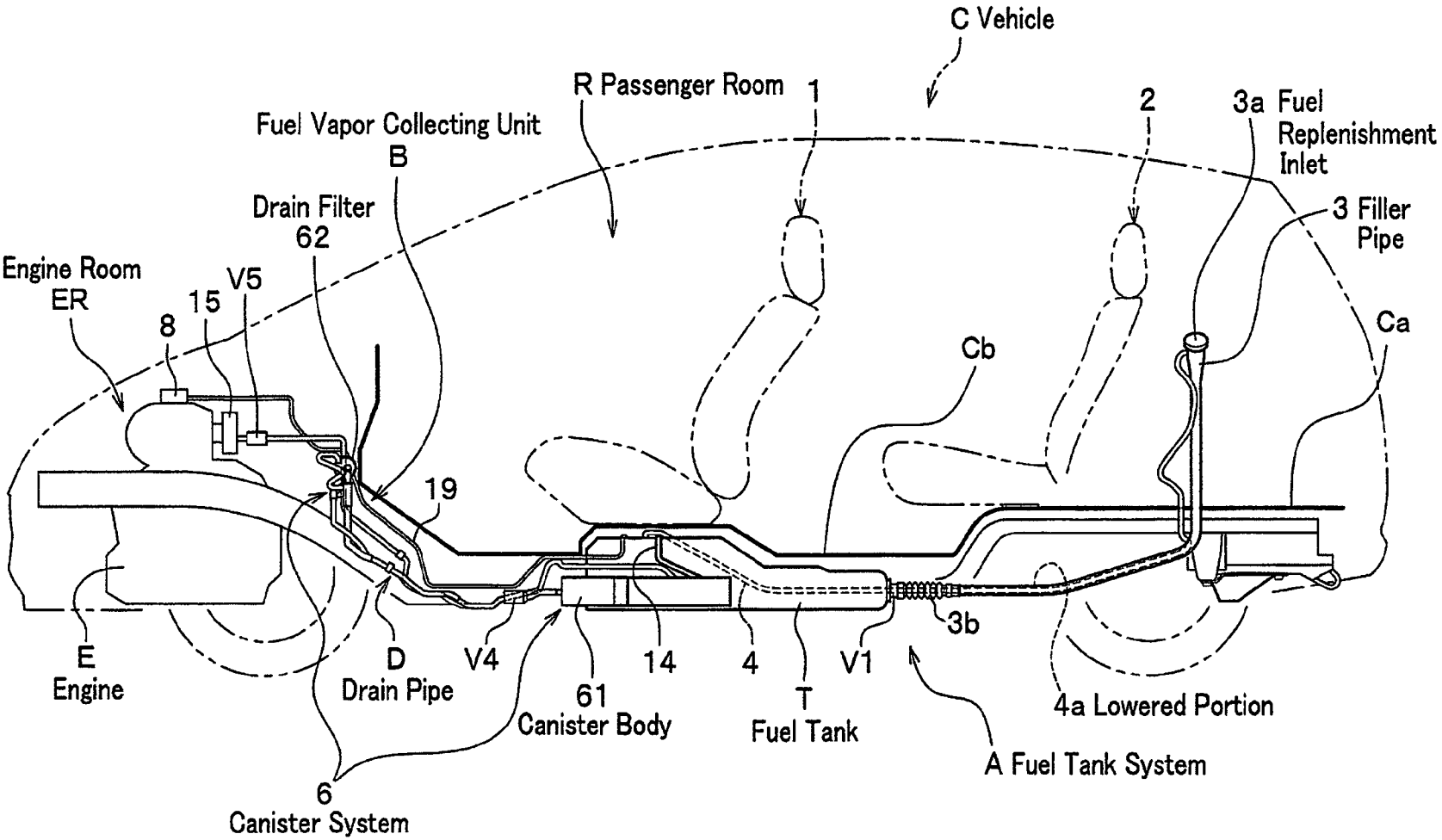
FIG. 1 is a side elevation view briefly illustrating a fuel tank system inclusive of a drain pipe in a canister system of the present invention.

A drain pipe in a canister system on an embodiment of the present invention is to be explained hereinafter in detail referring to FIG. 1 through FIG. 6. FIG. 1 indicates an approximate side view of a drain pipe in a canister system on an embodiment of the present invention.

Prior to explaining a drain pipe in a canister system on an embodiment of the present invention, a vehicle C in which a drain pipe D is installed, an explanation is made on a fuel tank T to be installed in the vehicle C, a fuel tank system A and a fuel vapor collecting unit.

Structure of the Vehicle

As described in FIG. 1, the vehicle C in which the drain pipe D is installed is a so-called center tank vehicle in which a center of gravity is made relatively located low, a fuel tank T and a canister body 61 are installed under a floor of a front seat 1 (under a floor panel Cb) and a relatively large space is created on the back side of a passenger room R. In a vehicle like the vehicle C, a fuel replenishment inlet 3*a* is located on the back side of a rear seat 2 and a filler pipe 3 and a vapor return tube 4 both of which extend from the fuel replenishment inlet 3*a* to the fuel tank T are made relatively long. The floor panel Cb is located at so low a position that the rear seat 2 is folded flat to be flush with a luggage floor Ca. Therefore in order not to have the vapor return tube interfere with the floor panel Cb or others, there is a lowered portion 4*a* of the vapor return tube 4 between the middle of the fuel tank T and the rear wheel. On both ends of this lowered portion 4*a* the vapor return tube 4 is curved.

Figure 2:
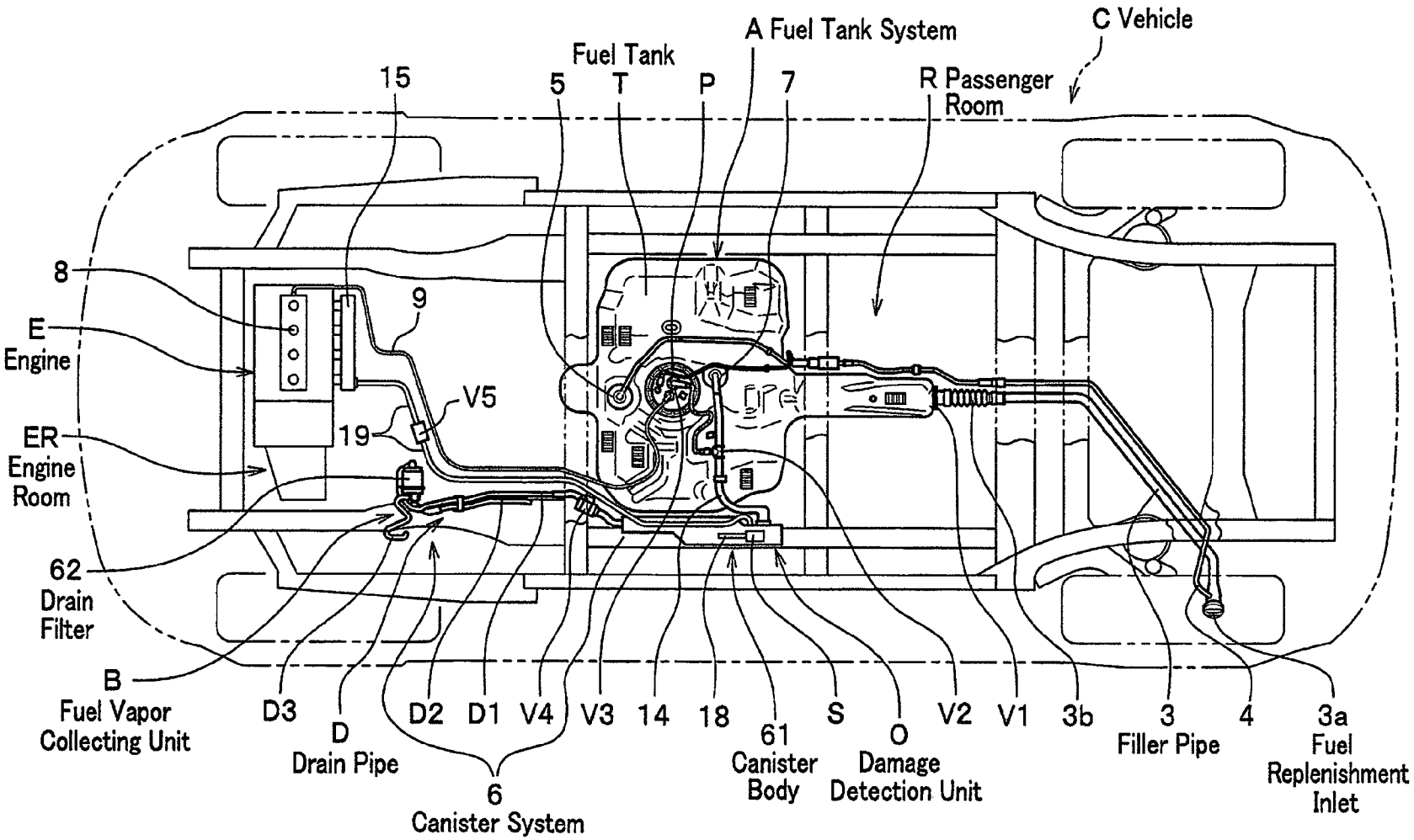
FIG. 2 is a plan view briefly illustrating a drain pipe in a canister system of the present invention.

FIG. 2 shows a rough plan view illustrating a drain pipe in a canister system of an embodiment of the present invention.

Fuel Tank Structure

The fuel tank T shown in FIG. 1 and FIG. 2 is intended for storing fuel and a filler pipe 3, one of whose ends is connected with a fuel replenishment inlet 3*a*, is connected to the fuel tank T through an inlet valve V1 and a fuel neck tube 3*b* on the rear end side of the fuel tank T. Above the fuel tank T the vapor return tube 4, one of whose ends is connected with the filler pipe 3 in the vicinity of the fuel replenishment inlet 3*a* which is located at a relatively high position, is installed along the filler pipe 3.

The vapor return tube 4 is meant for circulating part of the air in the upper part of the inside of the fuel tank T into the filler pipe 3 in the vicinity of the fuel replenishment inlet 3*a*. This vapor return tube 4 has also a function of reducing the amount of the air coming from the atmosphere into the fuel tank T through the fuel replenishment inlet 3*a* and the filler pipe 3.

As indicated in FIG. 1 and FIG. 2 there is a canister body 61 which is installed in parallel with the fuel tank T and connected with the fuel tank T through a vent pipe 14. On the front side of the canister body 61 a drain pipe D is attached and extends through a vent shut valve V4 to a drain filter 62 installed at an upper space in an engine room ER located on the front side of the passenger room R. The drain pipe D further extends back to the space under the floor of the passenger room R from the drain filter 62 and has the end opened and exposed to the atmosphere. The fuel tank T is installed on a lower side of the floor panel Cb under the front seats and fixed on the floor panel Cb with a couple of tank bands 12 ( see FIG. 4).

As indicated in FIG. 2 a pump module P, a vapor return float valve 5, a fuel replenishment float valve 7 are installed on the upper surface of the fuel tank T. The main part of the pump module P is inside the fuel tank T. Each of the fuel replenishment float and the fuel replenishment float has a float valve which is to be closed when the fuel tank is full of fuel.

Structure of Fuel Tank System

As indicated in FIG. 2 a fuel tank system A is composed of the fuel tank T, the filler pipe 3, the vapor return tube 4, an intake manifold 15, a fuel vapor collecting system B and a damage detection unit O. In the fuel vapor collecting unit B the fuel vapor generated in the upper portion of the inside of the fuel tank is transported to the canister system 6 not to have the fuel vapor come out to the outside while the fuel tank replenishment is under way. A damage detection unit O detects a hole in the pipes for the fuel tank replenishment if there is. The intake manifold 15 makes the pressure in the pipes inclusive of the fuel tank T, the filler pipe 3 and the vapor return tube 4 negative with respect to the atmosphere.

Figure 3:
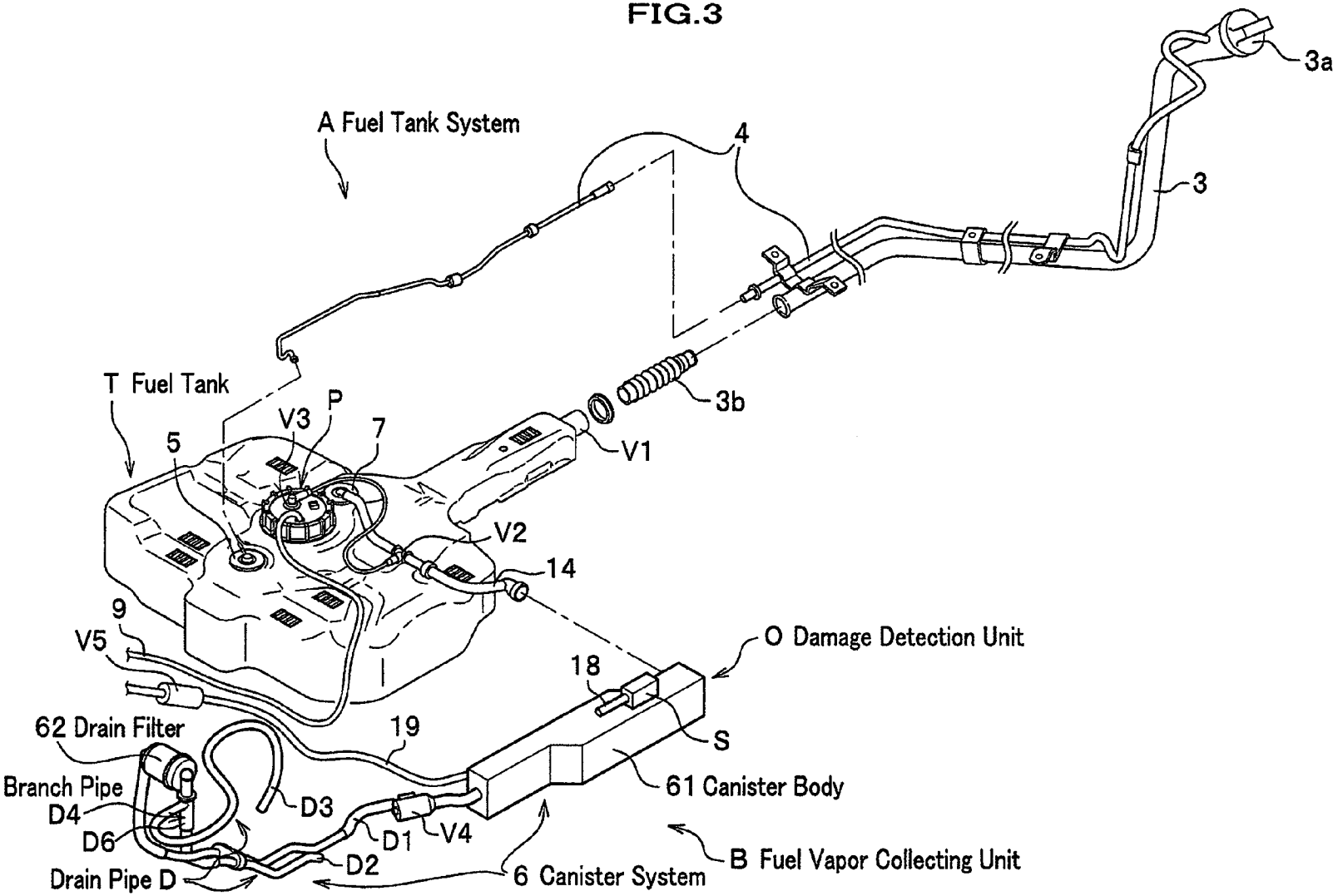
FIG. 3 is a perspective exploded view of essential parts of a drain pipe in a canister system of the present invention.

FIG. 3 shows an exploded perspective view illustrating an essential part of a drain pipe in a canister system of the present invention.

The pump module P illustrated in FIG. 3 is equipped with a suction filter not shown, a fuel pump to transport the fuel to an injector 8 shown in FIG. 2 through the fuel pipe 9, a fuel level meter not shown to detect the fuel level in the fuel tank T and a cut valve V3 connected with the canister body 61 through a fuel replenishment float valve 7, a vent relief valve V2 and a vent pipe 14, which constitutes a whole venting line. The pump module P includes these apparatuses and its main part is installed inside the fuel tank T.

The vent relief valve V2 is a differential pressure valve to be opened if the fuel vapor pressure increases inside the fuel tank T. The vapor return float valve 5 is to be closed not to have the fuel tank over-replenished and the fuel come into the vapor return tube 4 when the fuel tank is being replenished. The fuel replenishment float valve 7 is closed when the fuel tank T is full of the fuel and the fuel is prevented from coming into the canister body 61.

Structure of Fuel Vapor Collecting Unit

As is indicated in FIG. 3 the fuel vapor collecting unit B is intended to circulate the fuel vapor inside the fuel tank T through the vapor return tube 4, inhibit fuel vapor being generated from being discharged into the atmosphere by having the fuel vapor adsorbed in the canister system 6. This fuel vapor collecting unit B is composed mainly of the vapor return tube 4, the canister system 6, the vent pipe 14 connecting between the canister body 61 and the fuel tank T, a drain pipe D connected with the canister system 61 and a purge pipe 19 connected from the canister system 6 to the injector 8 (See FIG. 1 and FIG. 2) through a purge regulating electro-magnetic valve V5.

Canister Structure

The canister system 6 is to temporarily collect and store the fuel vapor in the fuel tank T, to supply the intake manifold with the stored fuel vapor by having the stored fuel vapor freed with the air suctioned by the negative pressure of the engine E with respect to the atmosphere (negative pressure refers to lower pressure than the atmosphere hereinafter) as well as to prevent the fuel vapor from being discharged into the atmosphere.

The canister system 6 consists mainly of the canister body 61, the drain filter 62, the drain pipe D and a vent shut valve V4. The canister body 61 contains adsorbent. On this adsorbent adsorbs the fuel vapor which is pressurized in the upper portion of the fuel tank T by the replenished fuel and transported therefrom during the fuel replenishment. The drain filter 62 is intended for removing dirt and dust contained in the air introduced from the atmosphere during purging. The drain pipe D is to connect between the canister body 61 and the drain filter 62 to supply air to the canister body 61. The vent shut valve V4 is installed in the drain pipe D between the canister body 61 and the drain filter 62.

As indicated in FIG. 2 the stored fuel vapor in the canister body 61 is purged while the engine is running and suctioned into the intake manifold 15 through the purge regulating electro-magnetic valve V5 together with air suctioned due to the negative pressure in the intake manifold 15. ECU not shown which is connected with the purge regulating electro-magnetic valve V5 controls the opening time of the purge regulating electromagnetic valve V5 based on several sensor outputs and the amount of the fuel vapor to be suctioned.

The intake manifold 15 is an air suctioning passage for the engine E, through which the cleaned air with an air cleaner is supplied to the engine E through a throttle valve not shown.

Structure of Canister Body

Figure 4:
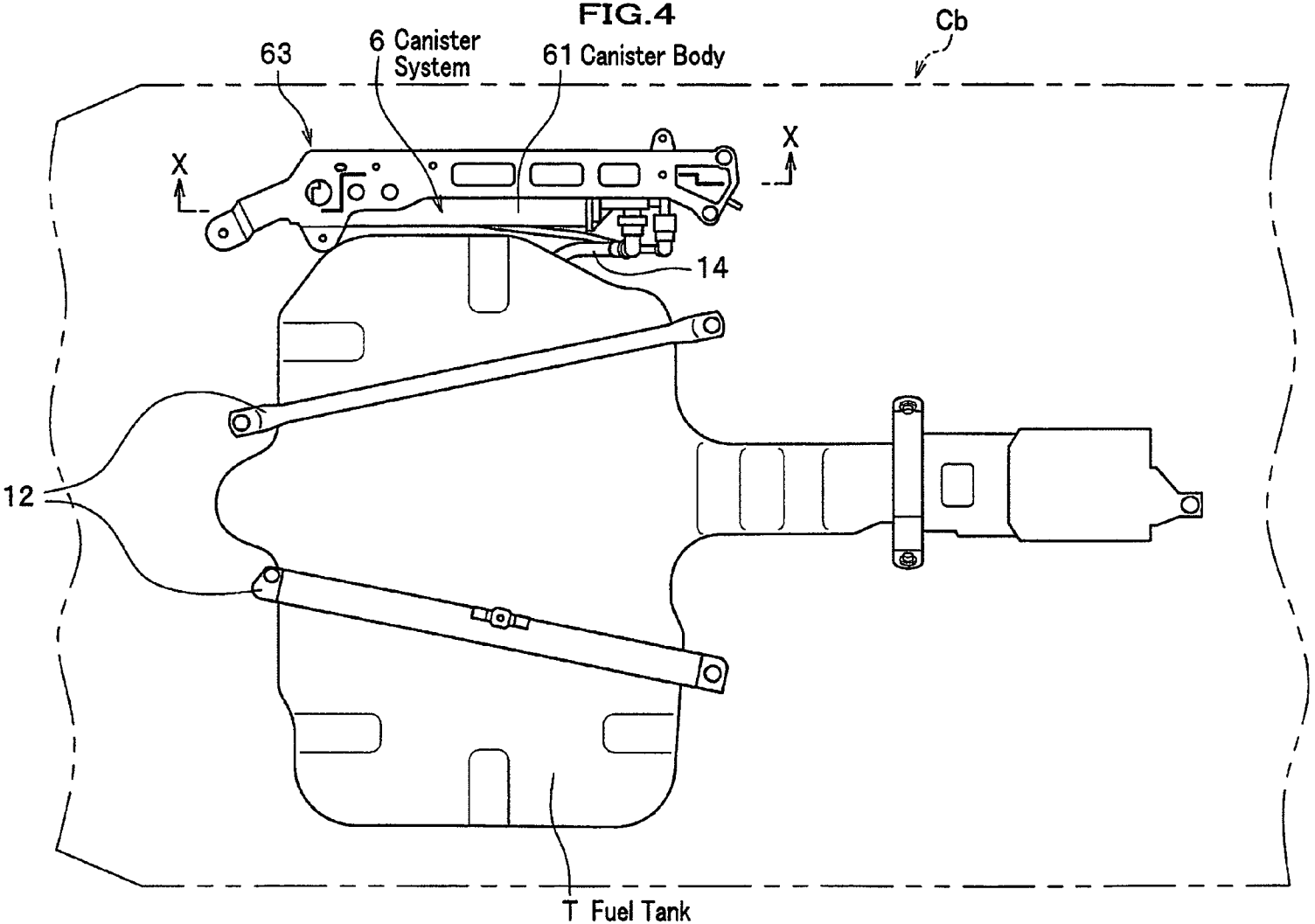
FIG. 4 is a enlarged figure indicating a drain pipe in a canister system of the present invention seen from under a vehicle and the installation condition of a canister body.
Figure 5:
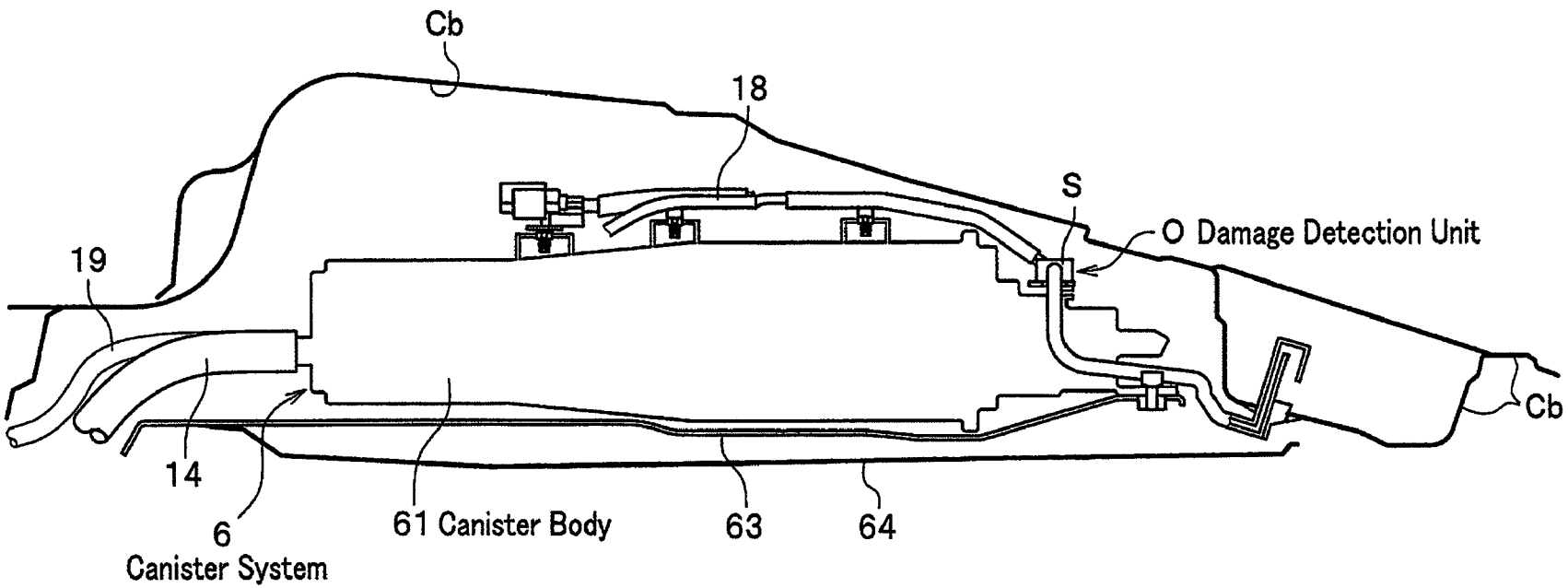
FIG. 5 is an enlarged cross sectional view illustrating the drain pipe in a canister system seen when cut along the X-X line in FIG. 4.

FIG. 4 is an enlarged view of a canister system seen from its underneath which is attached to a vehicle, indicating how the canister system is attached to a vehicle. FIG. 5 is an enlarged view of a cross section of the canister body cut along the X-X line in FIG. 4.

As indicated in FIG. 4 and FIG. 5 the canister body 61 is installed adjacent to the fuel tank T and is connected with the fuel tank T through a vent pipe 14 which is relatively thick and short in shape and has a small flowing resistance. The canister body 61 is attached through a rubber sheet to a bracket 63 made of a sheet of steel which is fixed on a lower side of the floor panel Cb. An attachment portion extending from the canister body 61 is not so robust as the canister body 61. As a result, in case the vehicle undergoes a collision and the floor panel Cb is deformed, the collision shock on the canister body 61 is absorbed by the deformation of the attachment portion and the rubber and the canister body 61 is prevented from breaking.

As seen in FIG. 5 the canister body 61 is covered with a protective plate made of plastic which is fixed on the lower side of the floor panel Cb. The canister body 61 is connected with the intake manifold 15 through a purge pipe 19 in which the purge regulating electro-magnetic valve V5 is installed (See FIG. 1 to FIG. 3). There is an inner pressure sensor S attached to the canister body 61 and a sensor pipe 18 is attached to the inner pressure sensor S with its end opened.

Structure of Drain Filter

A drain filter 62 as indicated in FIG. 2 is intended for removing dirt and dust contained in the air suctioned from the atmosphere and is a container containing a paper filter, for instance.

The drain filter 62 is installed at the highest position of or in its vicinity of the drain pipe D in the engine room ER. This drain filter 62 is attached to the front side of the separating wall with the dash board which forms an inner wall of the engine room ER and is fixed on the separating wall with a bolt tightened onto a bracket fixed in the upper part of the engine room ER.

Structure of Drain Pipe

As seen in FIG. 1 to FIG. 3 the canister system 6 is equipped with the drain pipe D. This drain pipe D consists of a connecting pipe D1, an exhaust pipe D2, an auxiliary pipe D3 and a branch pipe D4. The connecting pipe D1 connects between the canister body 61 and the drain filter 62, and extends to an upper portion of the engine room ER. There is a vent-shut valve V4 in this connecting pipe D1, which is electrically connected with and controlled by ECU not shown. This vent-shut valve V4 is closed only when the pressure of the fuel tank T is made negative.

The exhaust pipe D2 extends from the drain filter 62 to under the floor of the passenger room with one end connected to the drain filter and the other end exposed to the atmosphere. Through the exhaust pipe D2 is discharged into the atmosphere the cleaned air which comes through the drain filter 62 and fuel vapor from the fuel tank T is removed from.

In case the exhaust pipe D2 is clogged, air can be discharged from the canister body 61 through the auxiliary pipe D3 and suctioned through the auxiliary pipe D3 and the drain filter 62 into the canister body 61 with the adsorbed fuel vapor freed in the canister body 61 and transported through the purge pipe 19 to the intake manifold 15.

The auxiliary pipe D3 is branched from the branch pipe D4 which is attached in the vicinity of the drain filter 62 on the side exposed to the atmosphere.

Figure 6:
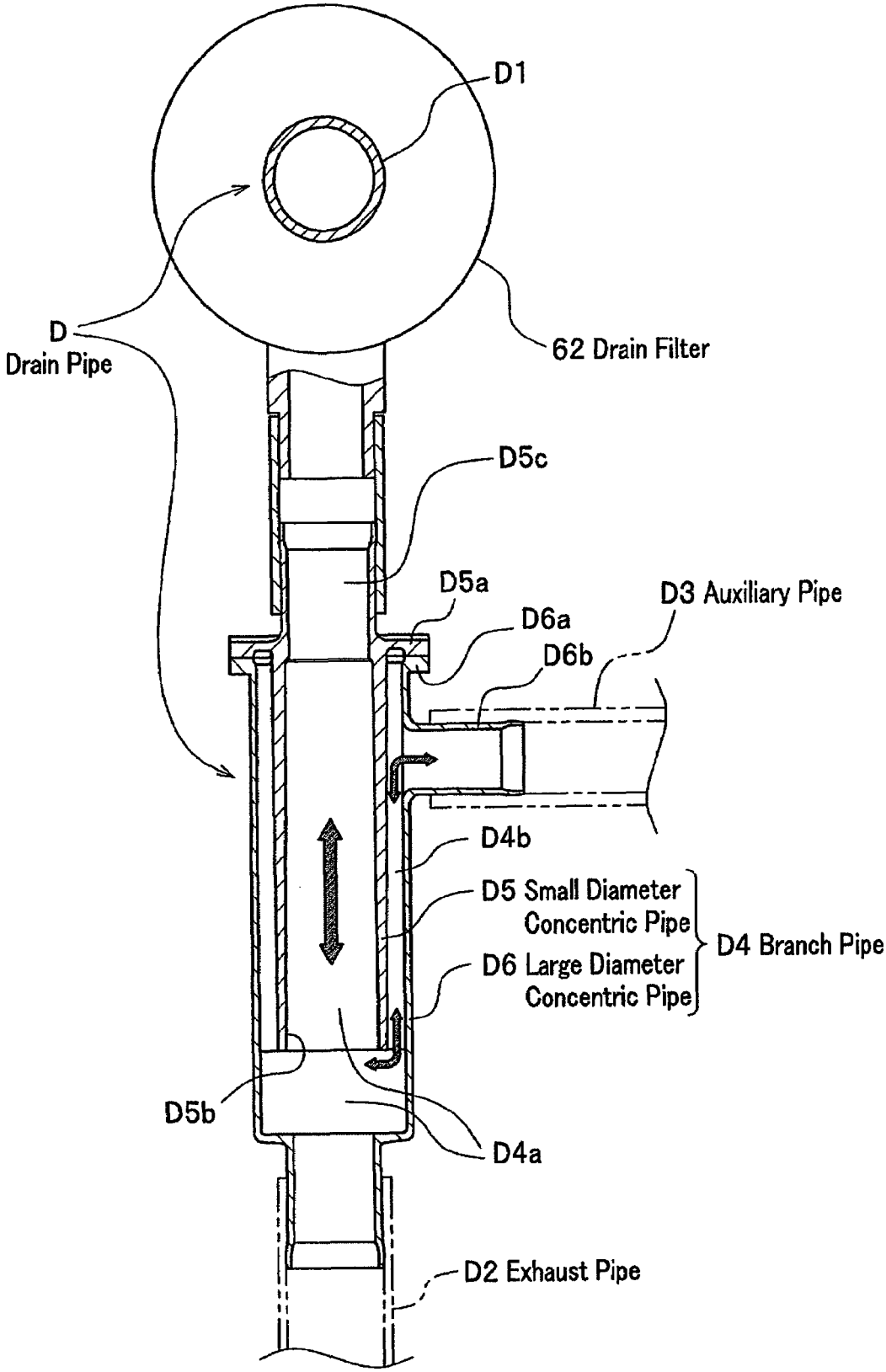
FIG. 6 is an enlarged cross sectional view illustrating a drain pipe in a canister system of the present invention and an essential part of a drain pipe in a canister system.

FIG. 6 is a cross section view showing an inner structure of a drain pipe in a canister system of the present invention.

As seen in FIG. 6 the branch pipe D4 has three joint portions, one joint portion connected with the drain filter 62, one with the exhaust pipe D2 and the other with the auxiliary pipe D3. The joint portion with the auxiliary pipe D3 branches from the other part of the branch pipe D3. The branch pipe D4 is a portion where both a flow passage from the exhaust pipe D2 to the drain filter 62 and another flow passage from the auxiliary pipe D3 to the drain filter 62 join.

The branch pipe D4 includes a small diameter concentric pipe D5 and a large diameter concentric pipe D6.

The large diameter concentric pipe D6 is composed of a cylindrical member with a flange portion D6*a* and a joint portion D6*b* through which the auxiliary pipe D3 is connected. The joint portion D6*b* is branched from the outer surface the cylindrical member.

The small diameter concentric pipe D5 is composed of a cylindrical member with a flange portion D5*a* and a joint portion D5*c* through which the branch pipe D4 is connected with the drain filter 62. The flange portion D5*a* is formed in agreement with the flange portion D6*a* so that the flange portion D5*a* is coupled with the flange portion D6*a*.

Because the small diameter concentric pipe D5 is sufficiently smaller in diameter than the large diameter concentric pipe D6, the small diameter concentric pipe D5 is installed inside the large diameter concentric pipe D6 with the flange portion D5*a* and the flange portion D6*a* in contact with each other and coupled together, which results in a double pipe structure.

Inside the branch pipe D4 there are formed a main flow passage D4*a* and an auxiliary flow passage D4*b*. The main flow passage D4*a* is formed by the small diameter pipe concentric pipe D5 and the portion of the large diameter concentric pipe D6 from the opening D5*b* of the small diameter concentric pipe D5 to the joint with the exhaust pipe D2. The auxiliary flow passage D4*b* consists of a space formed between an inner surface of the large diameter concentric pipe D6 and an outer surface of the small diameter concentric surface and a branched portion connected with the auxiliary pipe D3.

Because the auxiliary flow passage D4*b* in the drain pipe D includes the space formed between an inner surface of the large diameter concentric pipe D6, which is much narrower than the main flow passage D4*a*, there is a very small amount of air flowing toward the auxiliary pipe D3 compared with the air flowing toward the exhaust pipe D2 in the ordinary condition. In case the flow resistance in the exhaust pipe D2 becomes higher than in the auxiliary pipe D3, there flows more air toward the auxiliary pipe D3 according to the flow resistance in the exhaust pipe D2.

For instance, if the vehicle is submerged in water under its floor panel Cb and the exhaust pipe D2 is filled with water and clogged, air can flow through the auxiliary flow passage D4*b* and there does not occur a problem with the fuel tank T being unable to communicate with the atmosphere. As shown, the drain pipe portions D1, D2, D4 extend continuously from each other and the drain pipe portions D1-D3 extend continuously from each other, with the filter 62 disposed between portions D1 and D3.

Structure of Damage Detection Unit

The damage detection unit O is intended for detecting a hole on the fuel tank T and the pipes in the fuel tank system A if there is a hole generated, based on the inner pressure measured with an inner pressure sensor S (see FIG. 3). The damage detection unit determines whether or not a negative pressure is kept in the pipes in the fuel tank system A or the pressure in the pipes in the fuel tank system A is as high as the atmosphere, when the pressure in the fuel tank T and the pipes in the fuel tank system A is to be negative due to a negative pressure in the intake manifold 15, which is caused on ECU's request during engine's operation.

The ECU is electrically connected with such parts as the vent-shut valve V4, the purge regulating electromagnetic valve V5 and temperature sensors. The ECU takes a control over the vent-shut valve V4, the purge regulating electromagnetic valve V5 and other parts and gives an instruction to have the pipes in the fuel tank system A down to a negative pressure, have the canister body 61 purged and transport the fuel vapor adsorbed in the canister body 61 to the intake manifold 15.

Work of Drain Pipe

How the drain pipe D of the canister system 6 of the present invention works is to be explained with reference to FIG. 1 to FIG. 3.

To begin with, it is explained how the drain pipe D of the canister system 6 when the fuel tank T is replenished, with reference to FIG. 1 and FIG. 2.

For instance, when the fuel tank T is replenished after the engine E is switched off, fuel is poured into the fuel tank T from the fuel replenishment inlet 3*a*through the filler pipe 3. During this replenishment is transported into the canister system 6 through the vent pipe 14 fuel vapor remaining in the upper portion of the fuel tank T, whose volume amount is almost the same as the volume amount of the poured fuel into the fuel tank T. As a result the fuel replenishment is done smoothly.

Since part of the fuel vapor remaining in the upper portion of the fuel tank T is transported through the vapor return tube 4 and the vicinity of the replenishment inlet 3*a* to the filler pipe 3, the air from the atmosphere is inhibited from coming into the fuel tank T and it is possible to reduce the amount of the fuel vapor to be evaporated.

The fuel vapor coming from fuel tank T into the canister system 6 through the vent pipe 14 is adsorbed on the absorbent and stored. The air, from which the fuel vapor is removed, is discharged under the passenger room floor into the atmosphere out of the exhaust pipe D2 and does not flow inside the passenger room.

The canister body 61 is installed adjacent to the fuel tank T and connected with the vent pipe 14 which is so short and thick that air easily flows from the fuel tank T to the canister body 61 because of small air flow resistance in-between.

The fuel vapor flowing into the vapor return tube 4 flows toward the replenishment inlet 3*a* and circulates through the filler pipe 3 into the fuel tank T. As a result, an amount of air coming into the fuel tank T decreases, which results in reduction in an amount of fuel vapor generated.

Replenishment of the fuel tank T stops as soon as float valves not shown which are installed in the vapor return valve 5 and the replenishment float 7 are closed due to the fuel level becoming high, which leads to the fuel replenishment gun or nozzle not shown stopping flow.

Referring to FIG. 1, how the drain pipe of the present invention works while the canister system 6 being purged is explained.

When the canister body 61 is purged while the engine E is in operation, the purge regulating electromagnetic valve V5 is opened and fuel vapor adsorbed in the canister body 61 is transported into the intake manifold 15 of the engine E.

Specifically speaking, when the purge regulating electromagnetic valve V5 is opened, air is suctioned from the atmosphere through the exhaust pipe D2 and fuel vapor adsorbed on the adsorbent in the canister body 61 is suctioned into the intake manifold 15 through the connection pipe D1, the vent shut valve V4, the canister body 61, the purge pipe 19 and the purge regulating electromagnetic valve V5.

As a result the canister system 6 recovers its adsorbing capacity as fuel vapor adsorbed on the adsorbent is freed.

Since the drain filter 62 is installed at the highest position in the drain pipe D, water drops, dirt and dust are prevented from coming into the canister body 61 and the drain filter 62 is not clogged.

The branch pipe installed between the drain filter 62 and the auxiliary pipe D3 has a double pipe structure in which a small diameter concentric pipe D5 is disposed in a large diameter concentric D6 and there is a space between the small diameter concentric pipe D5 and the large diameter concentric pipe D6. Therefore an amount of air coming into and from the auxiliary pipe is restricted according to the flow resistance of the exhaust pipe D2. In case the exhaust pipe D2 is clogged with dirt, the canister body 61 remains communicated with the atmosphere through the auxiliary pipe D3.

The present invention does not have to be restricted in the embodiment above mentioned. Other modifications are also possible as long as they are within the scope of the present invention.

For instance the drain filter 62 is described to be disposed at highest position in the drain pipe D, however the drain filter 62 does not have to be at the highest position and is disposed at a relatively high position in the drain pipe D, the same effect as is already mentioned is obtained.

The invention claimed is:

1. A drain pipe in a canister system which is connected with a canister body installed under a front seat floor of a vehicle, the drain pipe, comprising;

a first part extending from the canister body up to an upper space of an engine room disposed on a front side of a passenger room, and a second part extending continuously from the first part to a space under a floor of the passenger room, which communicates with an atmosphere under the floor of the passenger room.

2. A drain pipe in a canister system according to claim 1, further comprising a drain filter installed on the drain pipe at or in a vicinity of a highest portion of the drain pipe in the canister system.

3. A drain pipe in a canister system according to claim 2, further comprising a branch pipe installed on the drain pipe and which has a double concentric pipe structure, and an auxiliary pipe which branches from the branch pipe and is installed in a vicinity of the drain filter and on an atmosphere exposed side of the drain filter.

4. A drain pipe in a canister system according to claim 2, wherein the first and second parts of the drain pipe are connected by the filter, such that the second part extends continuously from the first part via the filter.

5. A drain pipe in a canister system according to claim 1, further comprising a drain filter installed on the drain pipe in the upper space of the engine room.

6. A drain pipe in a canister system according to claim 3, wherein the branch pipe has a main flow passage and an auxiliary flow passage separately defined therein by the double concentric pipe structure.

7. A drain pipe in a canister system according to claim 6, wherein the auxiliary pipe communicates with the auxiliary flow passage and with the atmosphere.

8. A drain pipe in a canister system according to claim 3, wherein the second part of the drain pipe and the auxiliary pipe separately communicate with the atmosphere.

9. A drain pipe in a canister system according to claim 3, wherein the filter removes dirt and dust contained in air introduced from the atmosphere to the canister system when the canister system is being purged.

10. A drain pipe in a canister system which is connected with a canister body installed under a front seat floor of a vehicle, the drain pipe, comprising;

a first portion extending from the canister body up to an upper space of an engine room disposed on a front side of a passenger room, a second portion extending from the first part to a space under a floor of the passenger room and communicating with an atmosphere under the floor of the passenger room, and a filter interconnecting the first and second portions in the upper space of the engine room.

11. A drain pipe in a canister system according to claim 10, wherein the second portion of the drain pipe comprises a branch pipe which has a double concentric pipe structure which separately defines a main flow passage and an auxiliary flow passage, the main flow passage leading to the space under the floor of the passenger room, and the auxiliary flow passage flows into an auxiliary pipe that communicates with the atmosphere at a level higher than the space under the floor of the passenger room.

* * * * *